US005699847A

United States Patent [19]

Villette et al.

[11] Patent Number: 5,699,847

[45] Date of Patent: Dec. 23, 1997

[54] MOTORIZED ROLL-UP DEVICE FOR VENETIAN BLINDS

[75] Inventors: Jean De Chevron Villette, Annecy le Vieux; Jean-Michel Perache, Passy; Eric Lagarde, Sallanches, all of France

[73] Assignee: Somfy, France

[21] Appl. No.: 662,455

[22] Filed: Jun. 13, 1996

[30] Foreign Application Priority Data

Jun. 21, 1995 [FR] France ..... 95 07406

[51] Int. Cl.[6] ..... E06B 9/30

[52] U.S. Cl. ..... 160/168.1 P; 160/84.02; 160/DIG. 17; 160/170 R

[58] Field of Search ..... 160/168.1 P, DIG. 17, 160/170 R, 171 R, 1, 7, 84.02, 310

[56] References Cited

U.S. PATENT DOCUMENTS

| | | | |
|---|---|---|---|
| 3,049,175 | 8/1962 | Fukuoka . | |
| 3,474,761 | 10/1969 | Thomason | 160/170 R X |
| 3,559,024 | 1/1971 | Marder | 160/168.1 P X |
| 3,835,911 | 9/1974 | Horst et al. | 160/168.1 P |
| 4,856,574 | 8/1989 | Minami et al. | 160/168.1 P |
| 4,878,528 | 11/1989 | Kobayashi | 160/168.1 P |
| 5,318,090 | 6/1994 | Chen | 160/171 R |
| 5,396,944 | 3/1995 | Rossini | 160/170 R X |

FOREIGN PATENT DOCUMENTS

| | | |
|---|---|---|
| 0381643 | 8/1990 | European Pat. Off. . |
| 0533625 | 3/1993 | European Pat. Off. . |
| 0551053 | 7/1993 | European Pat. Off. . |
| 0573388 | 12/1993 | European Pat. Off. . |
| 900423 | 7/1949 | France . |
| 1763272 | 8/1970 | France . |
| 33 02 529 | 7/1984 | France . |
| 42 44 378 | 7/1994 | France . |
| 44 01 463 | 7/1994 | France . |
| 43 12 987 | 10/1994 | France . |
| 4-250286 | 4/1992 | Japan . |

*Primary Examiner*—David M. Purol

*Attorney, Agent, or Firm*—Laff, Whitesel, Conte & Saret, Ltd.

[57] ABSTRACT

Motorized device (2) for rolling up cords or tapes (13, 15) of Venetian or folded blinds, equipped with an automatic stopping device detecting a blockage of the motor. This automatic stopping device consists of a screw (6) carrying a traveling nut (7) rotationally retained in a tubular housing (9). Stoppage of the motor is caused by the detection of a blockage of the motor by the travelling nut (7) rotationally retained in a tubular housing (9). Stoppage of the motor is caused by the detection of a blockage of the motor by the travelling nut (7), or the blind, coming up against the casing. The bottom stopping point is adjusted by unblocking the cage (9) and rotationally driving it.

7 Claims, 1 Drawing Sheet

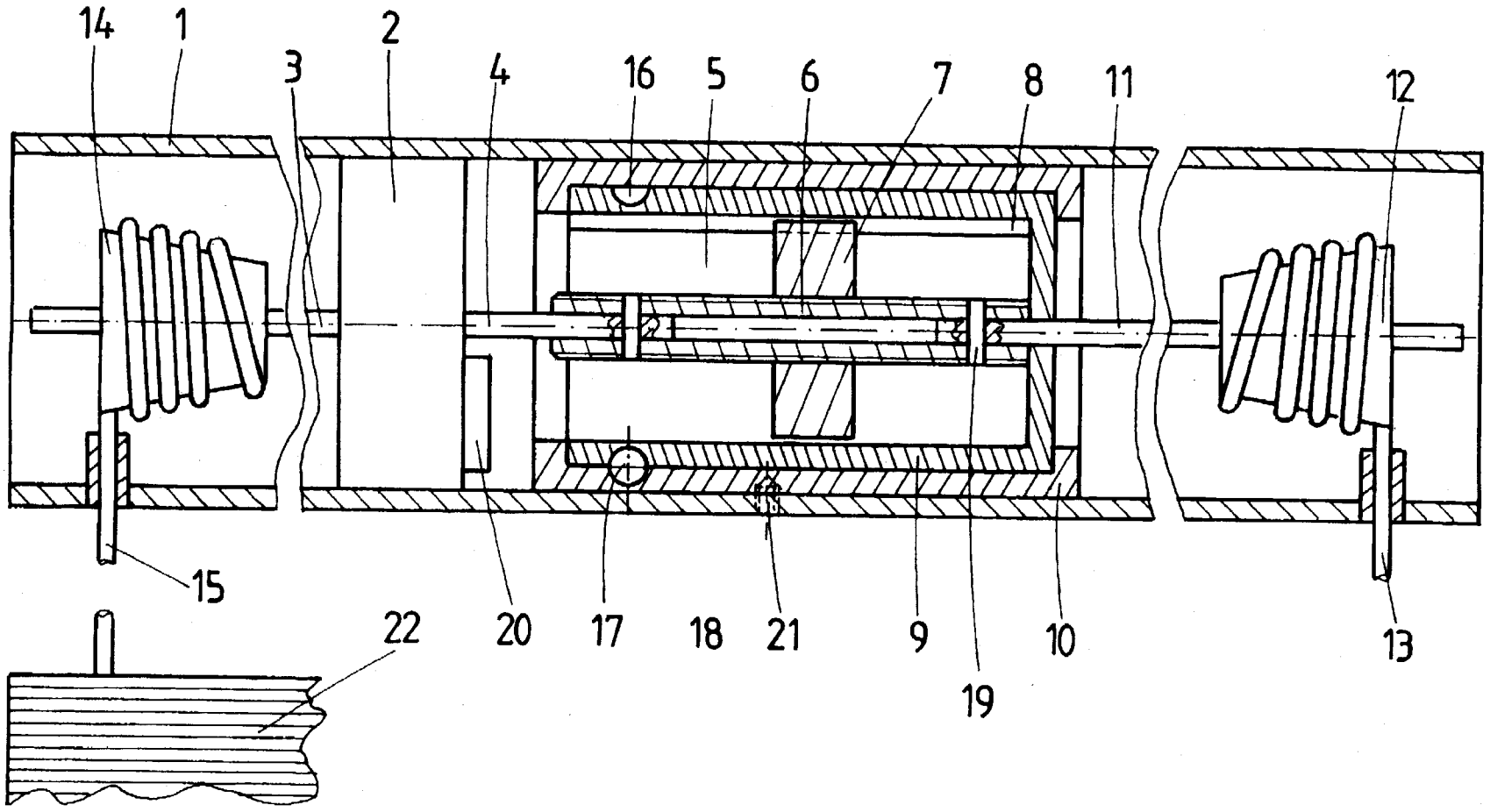
12
13
11
10
8
19
7
9
6
21
5
18
16
17
4
20
2
22
3
1
15
14

MOTORIZED ROLL-UP DEVICE FOR VENETIAN BLINDS

FIELD OF THE INVENTION

The subject of the present invention is a device for rolling up cords or tapes of a Venetian or folded blind comprising, housed in a casing, an electric motor equipped with a brake, a reduction gear, at least one output shaft driving two roll-up drums over which the cords or the tapes of the blind are wound, means for automatically stopping when the blind is completely rolled up, means for automatically stopping when the blind has reached a desired state of unrolling, means for detecting a blockage of the motor, causing the motor to be stopped on detecting such a blockage and means for adjusting the bottom stopping point corresponding to the desired state of unrolling.

PRIOR ART

Document DE 33 02 529 discloses a device for rolling up tapes for a Venetian blind equipped with a tubular gearmotor which is automatically stopped by a turns counter comprising two screws driven by the motor and each carrying a traveling nut in the form of toothed wheels engaged with a splined shaft which prevents them from rotating, each of these traveling nuts actuating a switch at the end of a certain movement, the actuation of these switches stopping the motor, respectively in the rolled-up position and in the unrolled position of the blind. The stopping point is adjusted by driving the splined shaft manually, this having the effect of moving the traveling nuts along their screws. Despite the adjustment possibilities afforded by these roll-up devices, they have the drawback that they do not take account of the hygrometric conditions at the time of installation and of variations in these conditions, which lead to variations in the length of the cords or of the tapes, or of length variations due to wear. If the moisture content is low, the cords extend and this extension, combined with the structural alterations in the installation, has the result that changes in the top stopping positions occur. In the case where several blinds are arranged side by side along the facade of a building, for example, the blinds are not all completely raised in the top stopping position since the stopping points are different from one another, which is particularly unsightly. If the moisture content is high, there is instead a decrease in the length of the cords, the consequence of this being mechanical stoppage by the packet of slats butting up against the casing of the installation before electrical stoppage. The motor therefore remains powered, cycling in pace with the thermal cutout, and is rapidly damaged. Furthermore, the stopping points are adjusted by means of a relatively complicated and delicate mechanical system.

Document DE 1,763,272 discloses a roll-up device for a Venetian blind, the top stopping point of which is provided by a switch actuated directly by the blind when it is completely rolled up and the bottom stopping point of which is determined by a turns counter comprising a single screw on which a traveling nut actuating a switch moves. A means for adjusting the stopping point in the completely unrolled position of the blind (bottom point) is not provided. For this purpose, it would be necessary either to drive the screw of the turns counter, which would require friction-driving means between the screw and the motor, or to move the switch, which would require mounting the switch on a screw. The use of a switch for stopping at the top point furthermore requires the running of wires between the switch and the motor.

Devices have also been disclosed for rolling up blinds in which the rolling element is stopped by detecting a drop in the rate of movement of the rolling element (EP 0 533 625, EP 0 573 388). Such devices require detection means and relatively expensive electronics.

Furthermore, various devices have been disclosed which detect the braking or blocking of a motor by detecting an excess of current (JP 42 50 286, DE 42 44 378), detecting a variation in speed (DE 44 01 463) or a drop in voltage on the auxiliary phase of an asynchronous motor (DE 43 12 987) or at the terminals of the phase-shift capacitor (EP 0 551 053).

Finally, manually driven Venetian blinds have been disclosed in which part of the drive shaft consists of a screw carrying a traveling nut moving between two stops consisting of nuts mounted and blocked on the same screw. The position of one of these screws determines the completely unrolled position of the blind, in which position the traveling nut comes up against this stop. Depending on the sense in which the device has been mounted, one or other of the butted nuts is used as the stop for stoppage in the unrolled position. In order to adjust the stopping point of the blind in the unrolled position (bottom point), the traveling nut is made to butt up against the stop determining the bottom point and the deployed and then locked blind. There is no means enabling this adjustment to be modified subsequently, which is very annoying. It is actually very difficult to set a blind, deployed, exactly to the desired unrolled position. Furthermore, in use, especially when first being used, with the elements being put in in place, changes in the actual stopping position occur. In order to modify the adjustment, it is then necessary to gain access to the stop nut and, to do this, it is necessary to dismantle the casing in which the roll-up device is mounted.

SUMMARY OF THE INVENTION

The object of the present invention is to provide a roll-up device comprising mechanically simple means for stopping the blind in the top and bottom positions, ensuring, in every case, that the blind is completely raised and enabling, by simple means, the adjustment of the bottom stopping point of the blind to be varied.

The roll-up device according to the invention is a device in which the means for stopping the blind in the desired unrolled position consist of a screw mounted coaxially and rotationally integral with said output shaft in a cylindrical cage prevented from rotating in the casing by manually actuable blocking means and of a traveling nut mounted on the screw and prevented from rotating in said cage, the motor being stopped in the completely rolled-up position of the blind by the blind coming up against the casing and a blockage of the motor being detected, and the blind being stopped at the bottom point by the traveling nut coming up against a fixed stop integral with the cage and a blockage of the motor being detected, the bottom stopping point being adjusted by unblocking said cage and rotationally driving it.

The stoppage of the motor by detecting its blockage may be carried out by any means for detecting or analyzing a variation in an electrical quantity associated with the mechanical blocking of the rotor of the motor, in particular by one of the devices described in the documents mentioned above.

The means for blocking the cage may consist, for example, of a simple screw, preferably a set screw, or of a meshing screw meshing with helical toothing formed on the perimeter of the cage. In the second case, the screw also enables the cage to be rotationally driven in order to adjust the bottom stopping point.

BRIEF DESCRIPTION OF THE DRAWINGS

The appended drawing represents, by way of example, one embodiment of the invention.

The single FIGURE of the drawing is a partial view in axial section of a roll-up device mounted in a casing.

DESCRIPTION OF THE PREFERRED EMBODIMENT

Mounted in a casing 1 of rectangular cross section are a gearmotor 2, having two opposed output shafts 3 and 4, and a turns counter 5. The counter 5 comprises a screw 6 extending the output shaft 4 and, by means of a pin 18, rotationally integral with this shaft and a traveling nut 7 prevented from rotating in a longitudinal groove 8 provided in the internal wall of a cylindrical pot-shaped cage 9 mounted in a cradle 10 solidly attached to the casing 1. The end of the screw 6 opposite the gearmotor 2 is, by means of a pin 19, rotationally integral with a shaft 11 carrying a first roll-up cone 12 over which a first cord 13 of a blind 22 is wound. On the other side, the shaft 3 carries a second roll-up cone 14 over which a second cord 15 is wound. The roll-up cones 12 and 14 are, for example, roll-up cones such as described in U.S. Pat. No. 5,328,113. The cage 9 is provided, over at least part of its circumference, with helical toothing 16 which meshes with a transverse screw 17 rotating in the cradle 10 and which is prevented from moving translationally in this cradle and is accessible from outside the casing 1. The cage 9 is therefore prevented from rotating by the screw 17, but it may rotate in its cradle while the screw 17 is being rotationally driven. The motor is furthermore equipped with a brake, for example an electromagnetic brake operating in the absence of supply current, and with means for detecting 20 a blockage of the motor, which detect, for example, an excess of current drawn cutting off said supply to the motor and to the brake when an excess of current drawn is detected. These detection means may be produced, for example, as described above in one of the documents mentioned above. Instead of an electromagnetic brake, the motor could be equipped with a mechanical brake having a nonreturn device.

The operation of this device is as follows:

When the blind is being installed, the traveling nut 7 is made to butt against the bottom of its cage 9, that is to say on the shaft 11 side. Next, the blind is locked in its unrolled position. In order to optimize the bottom stopping point, so as to allow the blind to be unrolled slightly further, the screw 17 is turned. The motor, being stopped and held blocked by its brake, the screw 6 is prevented from moving, so that rotational driving of the cage 9 enables the traveling nut 7 to be moved away from the bottom of the cage. The motor is then reactivated and the blind is unrolled until the traveling nut 7 comes up against the bottom of the cage 9. The motor is then blocked, an excess of current drawn is detected and the supply to the motor and to its brake is cut off. By successive approaches, the adjustment is optimized.

If, at the start, the blind is not unrolled enough, the procedure commences by rolling it back up slightly by activating the motor in the rolling-up direction so as to bring the blind into a position slightly above the desired bottom stopping position. The motor being stopped, the cage 9 is rotated by means of the screw 17 so as to bring the traveling nut 7 into abutment against the bottom of the cage. The situation is then again as in the above situation in which the blind is less unrolled than desired and the adjustment is made as previously.

The blind is stopped in the completely rolled-up position by the packet of slats of the blind 22 coming up against the casing 1, this having the effect of strongly braking the motor, the detection means 20 of which detect an excess of current drawn, this having the effect of cutting off the supply to the motor.

According to an alternative embodiment, the screw 17 is replaced by a simple radial screw 21, preferably a set screw. In this case, in order to unroll the blind slightly further, the bottom stopping point may be adjusted in another way. Having slackened the set screw, the motor is actuated. Although the traveling nut 7 butts up against the bottom of the cage 9, the screw 6 may rotate thereby driving the cage 9. When the desired stopping position is reached, the supply to the motor is cut off and the cage 9 is blocked by means of the set screw.

In order to unroll the blind less, the procedure commences by rolling up the cords by means of the motor so as to bring the blind into a position slightly above the desired bottom stopping position, as previously.

In this alternative form with a set screw, the unblocked cage 9 could be rotationally driven manually through a cutout provided in the casing. The driving could be direct or by means of a thumb wheel.

The pot-shaped cage 9 furthermore constitutes a dustproof housing which protects the screw 6 and its traveling nut. This is because, in known devices, it appeared that dust disrupts the operation of the automatic stopping device.

We claim:

1. Venetian or folded blind cord or tape roll-up device having a casing (1), an electric motor (2) mounted within said casing, two cord or tape roll-up drums (12, 14) mounted within said casing, at least one output shaft (3, 4, 11) connected to said motor and said two roll-up drums to drive said two roll-up drums, control means (20) connected to said motor to sense a blockage of said motor and to stop said motor from rotating said at least one output shaft, said roll-up device further comprising a cylindrical cage (9) mounted in said casing, said at least one output shaft having a cylindrical cage output shaft (4, 11) rotatably mounted within said cylindrical cage, a screw member (6) attached to said cylindrical cage output shaft (4, 11) to rotate with said cylindrical cage output shaft, an axially traveling stop member (7), attached to said screw member to move axially on said screw member, internal cage means (8) connected to said axially traveling stop member to prevent said axially traveling stop member from rotating relative to said cage and to axially move said axially traveling stop member on said screw member when said cylindrical cage and said screw member are rotated relative to each other, blocking means (17, 21) connected to said casing to selectively allow said cylindrical cage to rotate relative to said casing and to prevent rotation of said cylindrical cage relative to said casing, first stop means connected to said cylindrical cage to selectively stop the axial travel of said axially traveling stop member on said screw member to cause a first blockage of said motor when said blind is in a first selected position, and a second stop means to cause a second blockage of said motor when said blind is in a second selected position.

2. The roll-up device of claim 1 wherein said internal cage means is a longitudinal groove defined by an internal wall of said cylindrical cage, said axially traveling stop member is a nut member, said first stop means is to position said blind in a selected unrolled position and said second stop means is to position said blind in a selected rolled-up position.

3. The roll-up device as claimed in claim 1, wherein the blocking means is a helical toothing (16) formed on said cylindrical cage and a transverse meshing screw (17) meshing with said helical toothing wherein rotation of said meshing screw rotates said cylindrical cage to adjust positioning of said traveling stop member (7) on said screw member (6).

4. The roll-up device as claimed in claim 1, wherein the blocking means is a set screw (21) extending radially relative to the cage, the cage being rotated by loosening said set screw and unblocking the cage and rotationally driving said cage by the motor.

5. The roll-up device as claimed in claim 1, wherein the cage has an end bottom wall and said first stop means being said end bottom wall.

6. The roll-up device as claimed in claim 2, wherein the cage has an end bottom wall and said first stop means being said end bottom wall.

7. The roll-up device as claimed in claim 3, wherein the cage has an end bottom wall and said first stop means being said end bottom wall.

* * * * *